US008657591B2

(12) United States Patent
Hartmann et al.

(10) Patent No.: US 8,657,591 B2
(45) Date of Patent: Feb. 25, 2014

(54) MAIN COOLANT PUMP

(75) Inventors: Harald Hartmann, Kindenheim (DE); Uwe Bruhns, Gruenstadt (DE); Ralf Graber, Frankfurt (DE); Bernhard Brecht, Neustadt (DE); Juergen Kaufmann, Neustadt (DE)

(73) Assignee: KSB Aktiengesellschaft, Frankenthal (DE)

( * ) Notice: Subject to any disclaimer, the term of this patent is extended or adjusted under 35 U.S.C. 154(b) by 333 days.

(21) Appl. No.: 12/727,926

(22) Filed: Mar. 19, 2010

(65) Prior Publication Data

US 2010/0221127 A1 Sep. 2, 2010

Related U.S. Application Data

(63) Continuation of application No. PCT/EP2008/007747, filed on Sep. 17, 2008.

(30) Foreign Application Priority Data

Sep. 20, 2007 (DE) ..... 10 2007 045 126

(51) Int. Cl.
*F04B 17/00* (2006.01)
*F04B 35/04* (2006.01)

(52) U.S. Cl.
USPC ..... 417/360; 417/423.15; 417/423.14; 417/423.7

(58) Field of Classification Search
USPC ..... 417/423.1, 372, 424.1, 424.2, 360, 363, 417/423.7, 423.14, 423.15; 416/60; 403/349, 348; 411/116, 166, 119
See application file for complete search history.

(56) References Cited

U.S. PATENT DOCUMENTS

| | | | | | |
|---|---|---|---|---|---|
| 4,037,980 | A | * | 7/1977 | Haentjens | 403/336 |
| 4,084,876 | A | * | 4/1978 | Dinger | 439/439 |
| 4,084,924 | A | * | 4/1978 | Ivanoff et al. | 417/423.12 |
| 4,283,645 | A | * | 8/1981 | Hofmann | 310/87 |
| 4,362,413 | A | * | 12/1982 | Heard et al. | 403/14 |

(Continued)

FOREIGN PATENT DOCUMENTS

| | | |
|---|---|---|
| CA | 2 612 965 A1 | 2/2007 |
| DE | 24 47 542 A1 | 4/1975 |

(Continued)

OTHER PUBLICATIONS

International Search Reported with partial translation dated Dec. 17, 2008 and PCT/ISA/237 (thirteen (13) pages).

(Continued)

*Primary Examiner* — Charles Freay
*Assistant Examiner* — Alexander Comley
(74) *Attorney, Agent, or Firm* — Crowell & Moring LLP

(57) ABSTRACT

An engine pump assembly (1), particularly a main coolant pump, composed of a housing (4) of a rotary pump with delivery elements arranged therein, a heat barrier part (6), a motor part (5) which drives the delivery elements, and force transmitting connecting elements (7) between a housing flange (8) of the housing (4) of the rotary pump and a flange (21) of the engine part (5). For faster and more reliable assembly and disassembly, the housing flange (8) is provided with receptacles (12) over at least half of its periphery for the arrangement of screw heads (13, 15) of the connecting elements (7), which screw heads (13, 15) are held in a bayonet-like manner in the receptacles (12).

8 Claims, 4 Drawing Sheets

(56) References Cited

U.S. PATENT DOCUMENTS

| | | | | | |
|---|---|---|---|---|---|
| 4,757,786 | A | * | 7/1988 | Ellegard | 123/2 |
| 4,880,364 | A | * | 11/1989 | Berfield et al. | 417/423.1 |
| 4,898,518 | A | * | 2/1990 | Hubbard et al. | 417/360 |
| 5,044,883 | A | * | 9/1991 | Neueder | 415/214.1 |
| 5,275,538 | A | * | 1/1994 | Paliwoda et al. | 417/314 |
| 5,404,614 | A | * | 4/1995 | Stephens | 15/327.2 |
| 5,482,432 | A | * | 1/1996 | Paliwoda et al. | 415/168.2 |
| 5,538,406 | A | * | 7/1996 | Siegal et al. | 417/360 |
| 5,549,459 | A | * | 8/1996 | Nixon | 417/423.12 |
| 5,597,260 | A | | 1/1997 | Peterson | |
| 5,971,704 | A | * | 10/1999 | Blattmann | 415/173.2 |
| 6,126,359 | A | * | 10/2000 | Dittrich et al. | 403/349 |
| 6,755,157 | B1 | * | 6/2004 | Stevens et al. | 123/41.49 |
| 6,971,847 | B2 | * | 12/2005 | Tiemann | 415/209.2 |
| 2004/0071573 | A1 | * | 4/2004 | Pfetzer et al. | 417/423.15 |
| 2006/0104840 | A1 | * | 5/2006 | Queirel | 417/423.1 |
| 2007/0025865 | A1 | * | 2/2007 | Brecht et al. | 417/423.1 |

FOREIGN PATENT DOCUMENTS

| | | | |
|---|---|---|---|
| DE | 10 2005 036 347 | A1 | 2/2007 |
| EP | 1 148 248 | A2 | 10/2001 |
| EP | 1 389 669 | A1 | 2/2008 |
| GB | 2 065 760 | A | 7/1981 |
| GB | 2 203 491 | A | 10/1988 |
| GB | 2 266 749 | A | 11/1993 |
| JP | 51-143071 | | 11/1976 |
| JP | 3-86734 | U | 9/1991 |
| JP | 2001-330153 | A | 11/2001 |

OTHER PUBLICATIONS

Germany Search Report with partial translation dated Sep. 2, 2008 (nine (9) pages).

English translation of Japanese Office Action dated Mar. 19, 2013 (Four (4) pages).

* cited by examiner

MAIN COOLANT PUMP

CROSS REFERENCE TO RELATED APPLICATIONS

This application is a continuation of international patent application no. PCT/EP2008/007747, filed Sep. 17, 2008, designating the United States of America, and published in German on Apr. 2, 2009 as WO 2009/040037, the entire disclosure of which is incorporated herein by reference. Priority is claimed based on Federal Republic of Germany patent application no. DE 10 2007 045 126.3, filed Sep. 20, 2007.

BACKGROUND OF THE INVENTION

The invention relates to a motor/pump assembly, in particular a main coolant pump, comprising a housing of a rotary pump with conveying means arranged therein, a heat barrier part, a motor which drives the conveying means, and force-transmitting connecting elements between a housing flange of the rotary pump housing and a flange of the motor.

Main coolant pumps of this type designed as motor/pump assemblies have a pressure-resistant housing with integrated suction connection pieces and delivery connection pieces which are fixedly welded to pipelines in a leak-tight manner. The housing has a delivery-side opening for receiving a push-in part comprising a conveying means in the form of a rotating and guiding device, and also a heat barrier part and a motor part. The housing is closed by a pressure cover on the heat barrier part, to which an electric drive motor is coupled, in order to reduce a heat flow from the hot pump part to a motor part which should be kept cool. These parts are held together by connecting elements which are screwed into a flange of the housing and are extended through or past the heat barrier part. Further, the connecting elements extend through a motor flange and, on the side of the motor flange remote from the pump, hold the motor/pump assembly together with the assistance of nuts which bear against them. Such main coolant pumps are installed both vertically and horizontally in a power station. A vertical arrangement, preferably, directly below a steam generator, allows a cost-effective production of this power station part. Also, due to the arrangement below a steam generator, the construction volume in a power station is appreciably reduced.

To improve the availability of a power station, a type of construction of the motor/pump assembly has proved advantageous in which, in the event of maintenance or repair, the connection between the housing and motor part is opened and the motor, which is designed as a push-in part, together with the heat barrier part and the rotating pump part and with any internals in the housing, is withdrawn as a unit from the housing and is removed for maintenance and inspection work.

With regard to large power stations with a generating capacity of more than 800 megawatts, which for reasons of cost are designed as standard power stations, the spatial conditions for pump demounting are often greatly restricted.

SUMMARY OF THE INVENTION

An object of the invention was, therefore, to provide a large main coolant pump having a form of construction which, under confined installation conditions, ensures a rapid and reliable mounting or demounting for any inspection or repair purposes.

This and other objects have been achieved by the invention as described and claimed hereinafter.

In accordance with the present invention, the pump is provided with a housing flange having receptacles on at least half its circumference for receiving screw heads of connecting elements and for holding the screw heads in a bayonet-like manner therein.

These screw heads are an integral part of the connecting elements and act as tie rods between the rotary pump and the motor. Thus, after releasing the tension forces applied to the connecting elements and after the complete or partial removal of the associated nuts by which the tension forces are applied, the connection can be opened simply by rotating the screw heads held in a bayonet-like manner. These connecting elements can then be removed from the motor/pump assembly together with the push-in part. If the connecting elements are arranged over at least half the circumference, a push-in part withdrawn axially from the housing can easily be lifted out upwardly or downwardly or extracted laterally, depending on its installation position. This solution avoids the inadvertent seizure of such connections in the case of incorrect mounting due to the materials, usually duplex steels, used in such main coolant pumps.

In refinements of the invention, the receptacles are provided with position-securing latching faces which hold the screw heads in a mounting position and therefore ensure that a proper mounting position is reliably achieved. Non-latched screw heads cannot be braced.

The receptacles may be machined directly into the housing flange or they may be constructed as separate components and inserted into the flange. This type of design depends on available manufacturing equipment or on forces to be absorbed. It has proved advantageous for the rigidity of a housing flange if the receptacles are inserted from the motor side into the housing flange and held in a secure position therein. Separate components afford the advantage of accurate and planar machining, in order to ensure that the load-bearing faces of the two-part or multi-part T-heads come to bear simultaneously in the axial direction.

According to other refinements, at least one retainer is arranged between mounted screw heads and the housing flange. These retainers are designed so that they only function if the screw head is correctly inserted. The retainers can only be latched in place or attached when the load-bearing faces of the screw heads and receptacles bear completely one against the other. It also has proved advantageous if the screw heads are constructed as T-heads with at least two wings. Maximum load-bearing surfaces can thus be achieved in such a connection.

A minimum construction size can be achieved in the case of two-wing T-heads, if the slots through which the T-heads may be extended, are arranged in the receptacles tangentially with respect to the circumference of the flange. Also, depending on the nature and magnitude of the forces to be applied and on the available space conditions in the housing flange of the pump, multiple-wing screw heads may be used. In the case of an odd number of wings, the majority of the wings would then point toward the axis of rotation of the motor/pump assembly.

BRIEF DESCRIPTION OF THE DRAWINGS

The invention will be described in further detail hereinafter with reference to illustrative preferred embodiments shown in the accompanying drawing figures, in which.

DETAILED DESCRIPTION OF PREFERRED EMBODIMENTS

Figure 1:
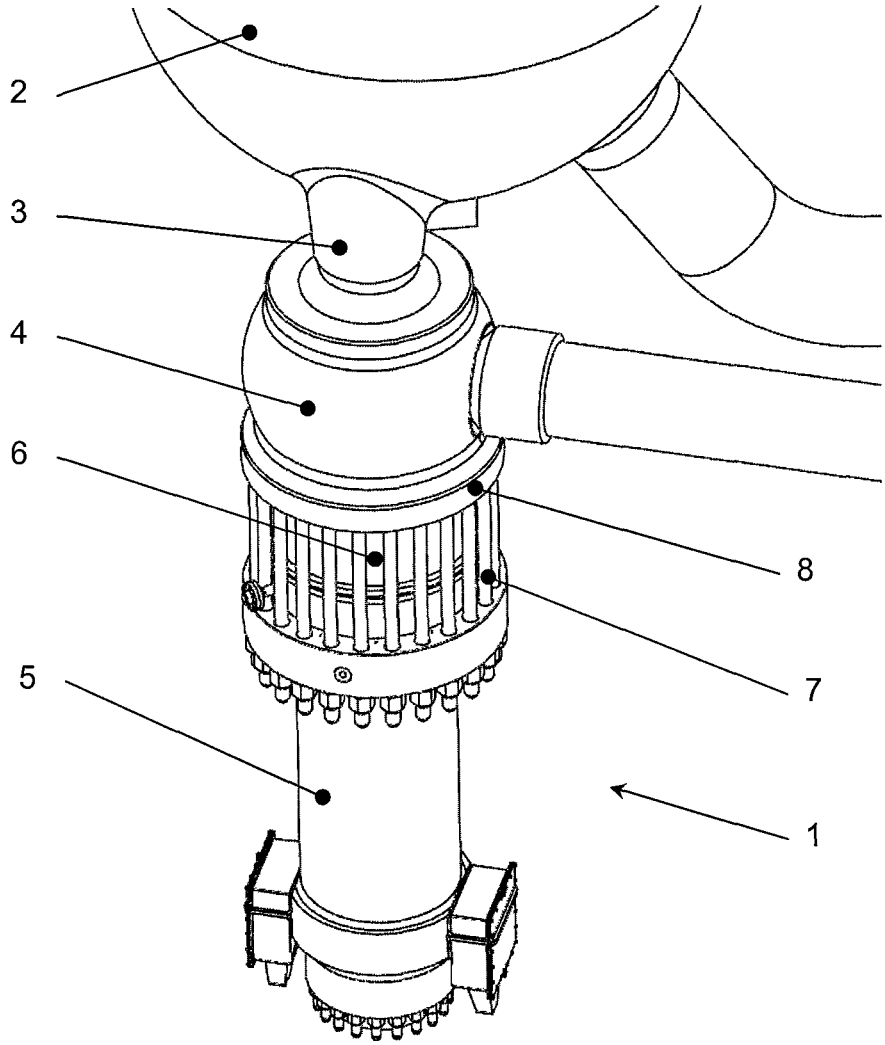
FIG. 1 shows a motor/pump assembly connected to a steam generator.

FIG. 1 shows a motor/pump assembly 1 which is suspended below a vertically mounted steam generator 2 and is welded to associated connecting pipelines of a coolant circuit. Thus, a primary circulation medium present in the steam generator 2 flows along the shortest path through a suction line 3 directly to the main coolant pump 1 and is conveyed further with the aid of the pump impeller of the coolant pump. All the pipelines of the coolant circuit are welded to the housing 4, while a motor part 5 and a heat barrier part 6 in the form of an insertable unit are attached by connecting elements 7 to a housing flange 8 of the housing 4 of the main coolant pump 1.

Figure 2:
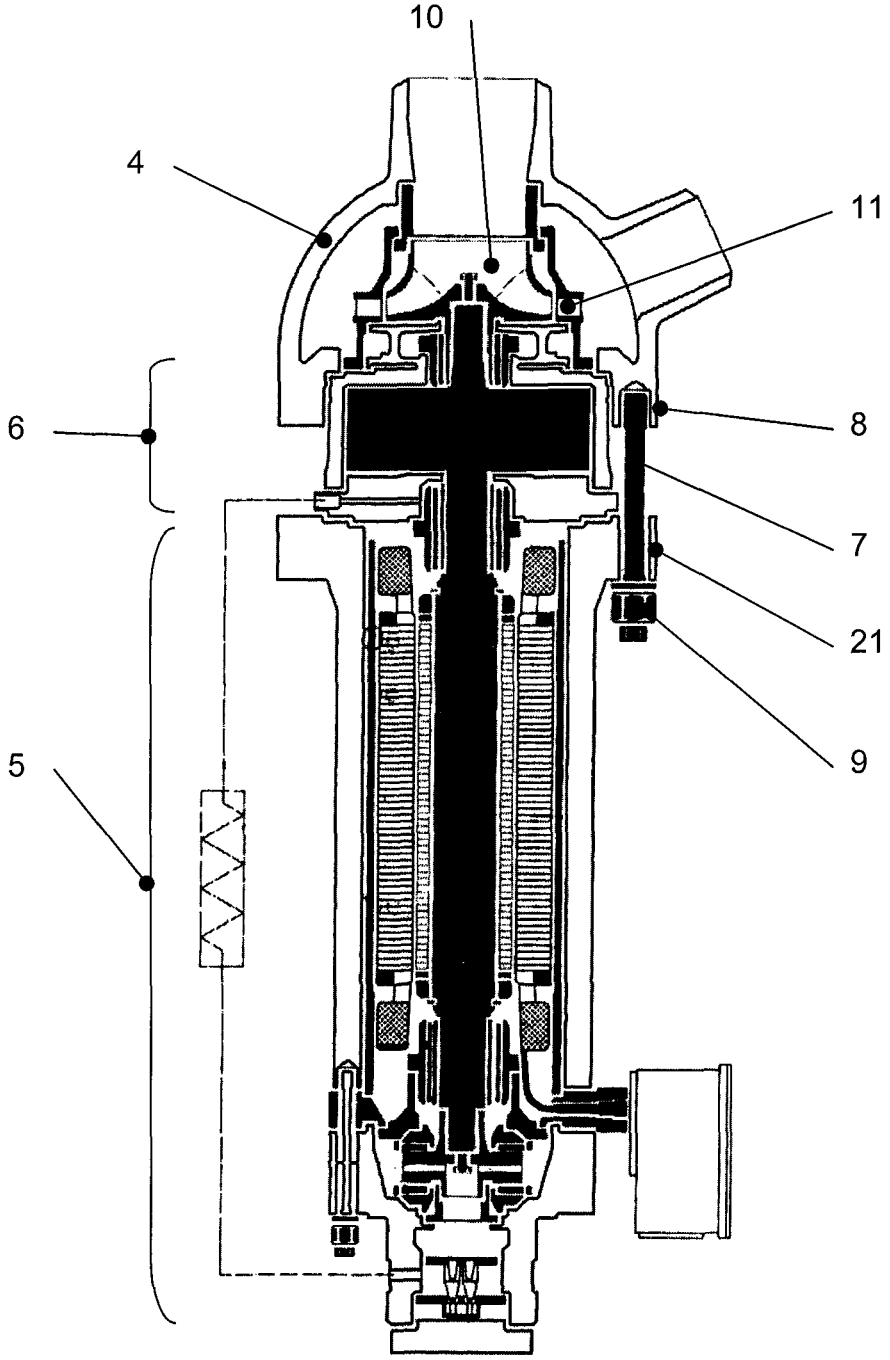
FIG. 2 shows a sectional view of a motor/pump assembly.

FIG. 2 shows a section through such a main coolant pump. In the event of maintenance, repair or inspection, the nuts 9 of the connecting elements 7, which are usually constructed as threaded bolts, are released, and the motor part 5 provided with a flange 21, is withdrawn from the housing 4 together with the heat barrier part 6 attached adjacent the pump, a pump impeller 10 and a flow-guiding housing insert 11.

In order to achieve mounting and lifting in a short time under confined space conditions, the connecting elements 7 arranged around at least half the housing flange 8 are constructed so that they can be removed from the housing flange 8 in a simple way. Thus, a pump insert, constructed as a cartridge or insert and comprising the motor part 5, heat barrier part 6 and impeller 10, is to be withdrawn only as far as the housing flange 8 of the housing 4. Subsequently, the complete pump insert can be lifted out or pivoted out laterally through the region freed by the connecting elements 7. With the duplex steels typically used in such main coolant pumps 1, screw connections tend very quickly to what is known as seizure if they are used or mounted incorrectly or under pressure of time. To that extent, a screw connection constitutes a risk which is not to be underestimated when mounting conditions or operating conditions are difficult.

Figure 3:
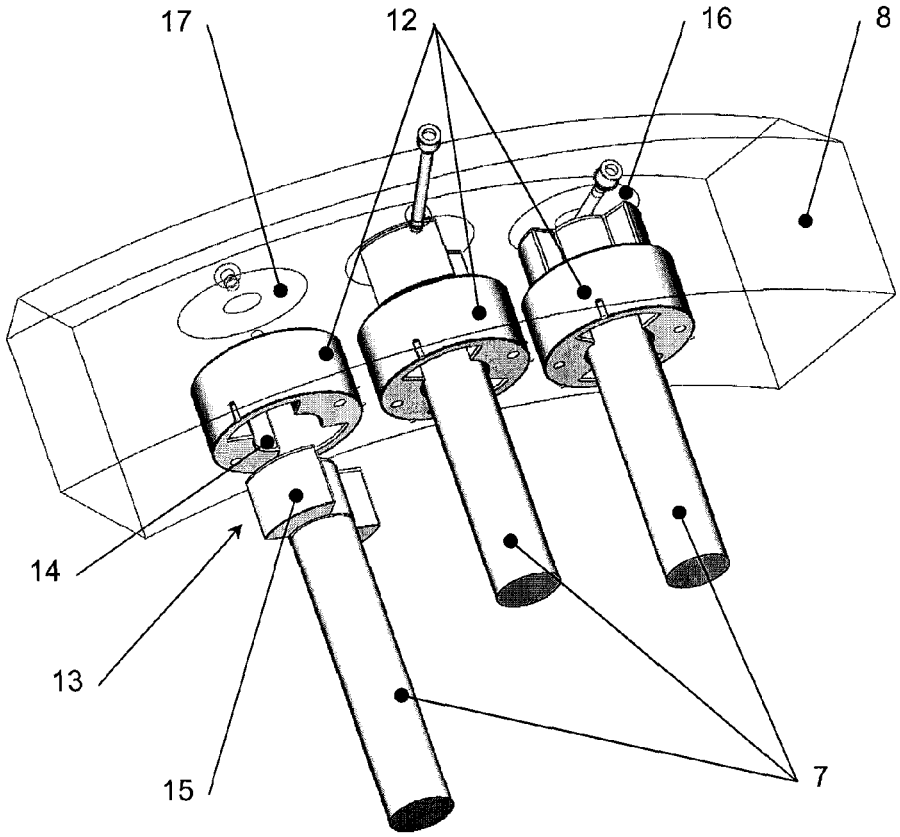
FIGS. 3, 4 and 5 show details of preferred arrangements of the T-head connecting screws.

FIG. 3 illustrates the risk avoidance which provides for the use of connecting elements 7 with screw heads 13 held in a bayonet-like manner in receptacles 12. FIG. 3 shows a detail of a transparent view from below of a housing flange 8, into which a screw head 13 of a connecting elements 7, designed here as a T-head screw, is mounted. For the sake of greater clarity, only three of a plurality of connecting elements 7 to be mounted are shown.

The receptacles 12, which have a slot 14 through which a matching T-head 15 of a connecting element 7, designed as a T-head screw, can be extended, are arranged within the housing flange 8. Such receptacles 12 can be produced in the solid and high-strength housing flange 8 by known metal-cutting machining operations. Located in each case within the housing flange 8 and behind the slots 14 of the receptacles 12 is a free space 16. Its size is dimensioned so that it is possible to rotate a screw head 13 or a T-head 15 within it. It is likewise possible to design the receptacles 12 as separate components which are attached to corresponding mounts on the housing flange 8, for example by being screwed into corresponding threaded bores.

Figure 5:
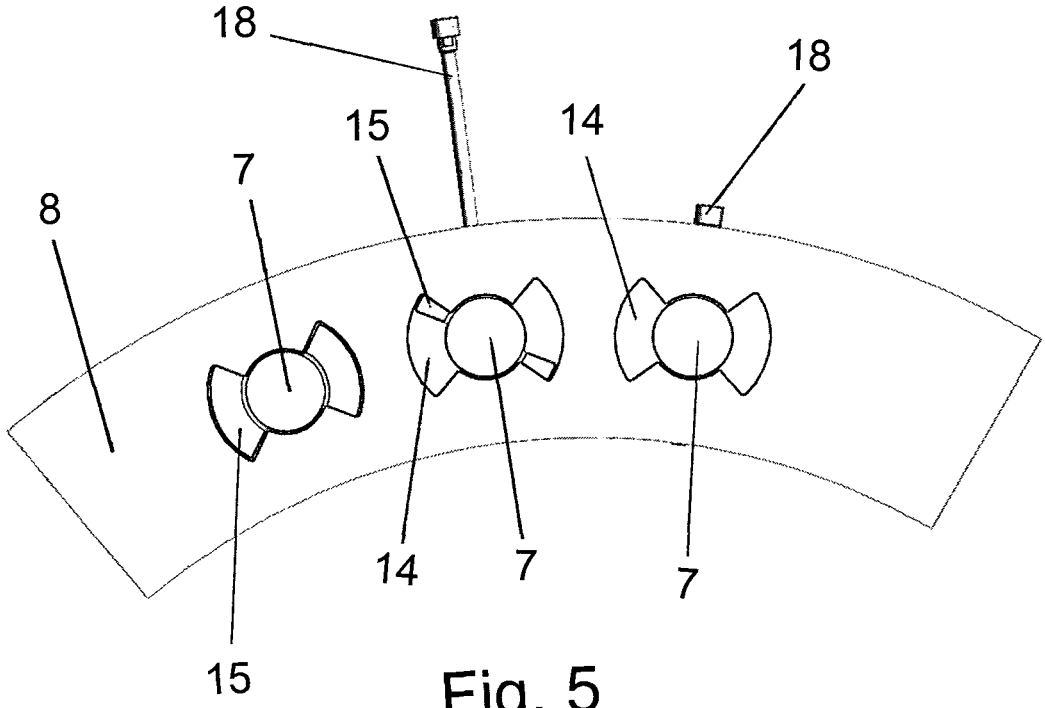

In order to achieve a small construction volume, a longitudinal axis of the slots 14, through which the T-heads 15 are extended, is arranged tangentially with respect to the circumference of the housing flange as shown in FIG. 5. Thus, particularly in the case of two-wing T-heads, mounting can take place with the T-head wings oriented approximately parallel to the circumference.

The here left-hand illustration of the total of 3 illustrations shows a T-head 15 before introduction to a receptacle 12. The illustration on the right next to it shows a T-head 15 which is extended completely through the slot 14 of the receptacle 12 and bears against a bottom face 17 within the free space 16. After a rotation of the T-head 15, here through 90 degrees, the latter is secured with its bearing faces against rotation in latching faces of the receptacle 12.

In order to secure the connecting elements 7 in their force-transmitting position, a retainer 18 is pushed from outside through a small bore into the housing flange 8 and is fastened therein. Such a retainer can only be mounted when each T-head 15 bears reliably against the latching faces of its receptacle 12. In the illustrative embodiment shown here, the retainer is depicted as a commercially available hexagon socket screw or Allen screw. Comparable means may also be selected.

Figure 4A:
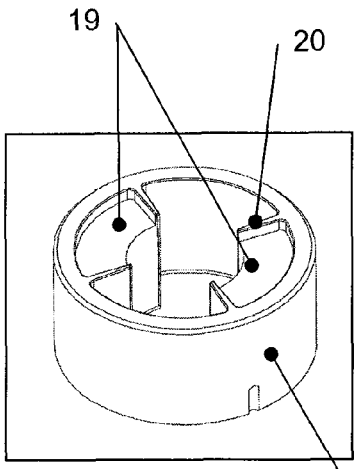
FIG. 4*a* is an enlarged perspective detail view of a receptacle from FIG. 4.
Figure 4:
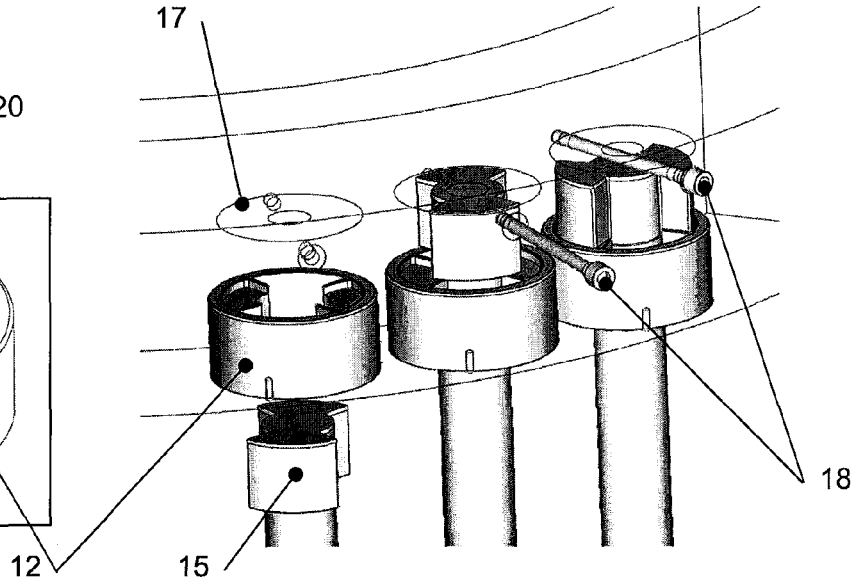

FIG. 4 shows another view of a transparent illustration according to FIG. 3, here a view from above of the housing flange 8 and of connecting elements 7 to be mounted therein.

The left-hand illustration shows a view of the receptacle 12, with latching faces 19 arranged therein, and a T-head 15 before its introduction. Latching means 20 can be seen clearly, illustrated here as strip-like elements. These latching means may also be constructed as punctiform elevations or depressions. It is proved advantageous to integrate the latching means into one of the components so that they cannot be lost during mounting or demounting.

The middle T-head 15 is illustrated in the introduced state, bearing against the bottom face 17 of the free space 16, and before its rotation. The free space 16 has an axial length sufficient to allow a rotation of the T-head 15 above the latching means 20.

The T-head 15, on the right here, is shown in a latched and secured state. In this view, the T-head lies completely against the latching faces 19, and, when the screw connection is being closed as a result of the tightening of the nuts 9, as depicted in FIG. 2, the latching means 20 prevent connecting elements 7 from rotating.

In the state of the middle connecting elements shown, equipped with a T-head 15, it is not possible to mount a retainer 18. The T-head blocks the way for the retainer 18. Only when a T-head 15 has reached its force-transmitting position in the receptacle 12 and consequently has attained a somewhat lowered position, can retainer 18 be mounted completely in the housing flange through free space between the top of the T-head 15 and the bottom face 17 of the free space 16. The height of this free space for receiving the retainer corresponds at least to the height of a latching means 20 above the latching face 19.

Conversely, if a retainer 18 is mounted before a T-head 15 is inserted, a T-head 15 cannot be pushed completely into the free space 16 and therefore also cannot be rotated into the force-transmitting position. This ensures that load-transmitting contact cannot be generated when a nut 9, supported on the flange 21 of the motor part 5, or the connecting elements 7 is tightened.

FIG. 4*a* is an enlarged perspective view of a receptacle 12 for a two-wing T-headed connecting bolt in which the latching faces 19 for the wings of the T-head and the raised latching ridges 20, which prevent the T-head from rotating out of position after its wings have been properly seated against the latching faces 19, are both clearly visible.

FIG. 5 is a view from the underside of housing flange 8 which shows the connecting elements 7 in three positions with respect to the flange. In the left portion of the figure, the connecting element 7 is oriented with the wings of its T-head 15 aligned with the slot 14, so that the head of the connecting element can be inserted through the slot. In the central portion of the figure, the connecting element 7 has been turned after having been inserted through the slot so that a major portion of the wings of T-head 15 overlies the flange 8, and only a minor portion of the wings is visible through the slot 14. In the right portion of the figure, the connecting element 7 has been turned to its installed position and seated against the latching face 19 of the receptacle 12, so that it is no longer visible at all through the slot 14. After the T-head of the connecting element is seated in the receptacle 12, retainer 18 is inserted through the flange 8 above T-head 18 to prevent the T-head from being lifted off the latching face 19 and out of receptacle 12, thereby securing the connecting element 7 in its proper load-bearing position in the housing flange 8.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

The invention claimed is:

1. A motor/pump assembly comprising a rotary pump housing with conveying means arranged therein, a heat barrier, a motor for driving the conveying means, and force-transmitting fasteners extending between a flange of the rotary pump housing and a motor flange, wherein the force-transmitting fasteners are removable from the rotary pump housing flange and the motor flange, at least half the circumference of the rotary pump housing flange is provided with receptacles for receiving and holding screw heads of the force-transmitting fasteners therein in a bayonet-like manner, where the screw heads are arranged such that no portion of the force-transmitting fasteners may be advanced beyond a surface of the screw heads opposite a load-bearing surface of the screw heads which contacts the rotary pump housing flange, and said receptacles are provided with position-securing latching faces which hold the screw heads in a proper mounting position.

2. The motor/pump assembly as claimed in claim 1, wherein the receptacles are constructed as separate components.

3. The motor/pump assembly as claimed in claim 2, wherein the receptacles are inserted from a motor side into the rotary pump housing flange and secured in position therein.

4. The motor/pump assembly as claimed in claim 1, wherein at least one retainer is arranged between mounted screw heads and the rotary pump housing flange.

5. The motor/pump assembly as claimed in claim 1, wherein the screw heads are constructed as at least two-wing or multi-wing T-heads.

6. The motor/pump assembly as claimed in claim 5, wherein the screw heads are constructed as two-wing T-heads, and slots through which the T-heads are extended, are arranged in the receptacles tangentially with respect to a circumference of the rotary pump housing flange.

7. The motor/pump assembly as claimed in claim 1, wherein said rotary pump housing is connected to coolant pipes of a cooling circuit for circulating liquid coolant through a cooling system.

8. The motor/pump assembly as claimed in claim 1, further comprising latching ridges bounding the position-securing latching faces of the receptacles.

* * * * *